US006030040A

United States Patent [19]

Schmid et al.

[11] Patent Number: 6,030,040

[45] **Date of Patent: *Feb. 29, 2000**

[54] SEAT AND/OR BACKREST PART OF FOLDING FURNITURE, ESPECIALLY GARDEN OR CAMPING FURNITURE

[75] Inventors: Ralf Schmid, Kempten; Boris Schweitzer, Lindenberg; Peter Seitz, Waltenhofen-Oberdorf; Peter Brutscher, Börwang, all of Germany

[73] Assignees: Simone Burk-Seitz; Marita Lenhardt; Heike Brutscher, all of, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/934,428

[22] Filed: Sep. 19, 1997

[51] Int. Cl.[7] ..... A47C 7/02

[52] U.S. Cl. ..... 297/284.2; 297/440.11; 297/452.13; 297/226

[58] Field of Search ..... 297/440.11, 452.13, 297/226, 284.2

[56] References Cited

U.S. PATENT DOCUMENTS

| | | | |
|---|---|---|---|
| 3,041,109 | 6/1962 | Eames et al. | 297/452.13 |
| 3,677,601 | 7/1972 | Morrison et al. | 297/440.11 |
| 3,844,612 | 10/1974 | Borggren et al. | 297/440.11 |
| 4,837,878 | 6/1989 | Huemer | 297/284.2 |
| 5,338,091 | 8/1994 | Miller | 297/226 |
| 5,507,563 | 4/1996 | Arthur | 297/452.13 |
| 5,762,403 | 6/1998 | Robinson | 297/452.13 |

FOREIGN PATENT DOCUMENTS

| | | |
|---|---|---|
| 7735346 | 3/1978 | Germany . |
| 3513076 | 10/1986 | Germany . |

*Primary Examiner*—Peter M. Cuomo
*Assistant Examiner*—Anthony D. Barfield
*Attorney, Agent, or Firm*—Greer, Burns, & Crain, Ltd.

[57] ABSTRACT

A seat and/or backrest part of folding furniture, especially garden or camping furniture, comprising a frame and a cover which may be anchored to this frame. The frame includes two hollow sections which are arranged at a distance from one another determining the width or length of the seat or backrest surface and are open on at least one face and with a longitudinal slot, in such a way that the cover may be led into and through the open face of the hollow sections and their longitudinal slot. The edges of the cover are held inside the hollow sections by edge strips formed on same. The edge strips may be displaced inside the hollow sections in a direction perpendicular to their longitudinal extension with corresponding tensioning of the cover.

6 Claims, 2 Drawing Sheets

Figure 1:
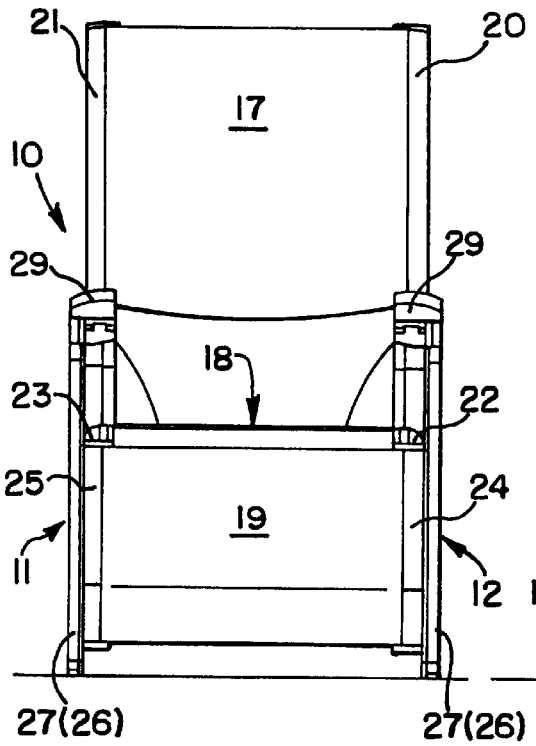

SEAT AND/OR BACKREST PART OF FOLDING FURNITURE, ESPECIALLY GARDEN OR CAMPING FURNITURE

SPECIFICATION

The invention relates to the construction of a seat and/or backrest part of folding furniture, especially garden or camping furniture, comprising a frame and a cover which may be anchored to this frame, especially a textile cover.

Seat and/or backrest parts of this kind are widely known. Traditionally the cover is securely connected to the frame portions of the folding furniture, especially of the seat and/or backrest part. In accordance with this, the corresponding piece of furniture must be delivered to the end-user with the cover fixed to it. The end-user does not have the possibility of attaching the cover subsequently or of exchanging it himself after use. In addition, on this known construction the user does not have any way of regulating the tension of the cover if required.

The object underlying the present invention is to design the seat and/or backrest part of folding furniture, especially garden or camping furniture, so that they can be packed into the smallest space without any regard for the cover, the idea being that it should be possible to attach the cover subsequently, according to the individual requirements of the user.

This object is achieved according to the invention by the characteristic features of claim 1, the secondary claims relating to preferred constructional details of the basic concept according to the invention.

The core of the present invention resides, therefore, in the fact that the frame of the seat and/or backrest part includes two hollow sections, so-called edge strip profiles, open at least on one face and provided with a longitudinal slot, to which sections the cover, generally a textile cover, may be fastened, and this may be done by the user. For this purpose, the cover has on each of the edges associated with the above-mentioned sections a bead-like edge strengthening or so-called edge strip which may be placed inside the hollow profile. The diameter of the edge strips is larger than the width of the longitudinal slots in the hollow sections, with the result that the cover may be securely anchored to the hollow sections. The edge strips of the cover are led into the hollow sections through the open faces of same, the cover extending at its edges through the longitudinal slots of the hollow sections. On the finished piece of furniture, the open faces of the hollow sections must, of course, be easily accessible from the outside.

A further special feature of the present invention resides in the fact that the edge strips may be displaced inside the hollow sections in a direction perpendicular to their longitudinal extension. In this way, tensioning and especially regulating the tension of the cover is possible.

To this end, the hollow sections serving to anchor the cover each have a hollow space like a longitudinal groove inside which the edge strips may be moved backwards and forwards by means of an associated tensioning device with a corresponding change in the tension of the cover in a direction perpendicular to the longitudinal extension. The hollow space, which is like a longitudinal groove, of each hollow section preferably extends approximately parallel to the stretched surface of the cover. The hollow sections are placed inside the piece of furniture in such a way that the longitudinal slots in each case extend on the upper side facing the cover.

In a concrete embodiment, the edge strips of the cover are in each case formed by a rod, especially a round rod, driven into the edges of the cover.

The tensioning device associated with the edge strips of the cover preferably includes a push rod which is disposed inside the hollow section, extends over the whole length of the associated edge strip and lies adjacent to the edge strip on the side of the edge strip facing the cover. In addition, the tensioning device includes at least one tension screw impinging on the push rod at the side facing the cover. By screwing in said screw to a greater or lesser extent, the push rod and with it the associated edge strip is pushed backwards and forwards inside the hollow space like a hollow groove of the associated hollow section in a direction perpendicular to its longitudinal extension, resulting in a corresponding tensioning of the cover.

The tension screw is supported inside a threaded bore hole formed in the hollow section or alternatively inside a threaded bush anchored in the hollow section. Where the hollow section is very long, two or more tension screws can also be allocated to the push rod mentioned.

The hollow consists by preference of plastic or metal, especially aluminium.

In order to form a self-supporting stable frame for the seat and/or backrest part, the hollow sections associated with these parts are preferably connected to one another by cross struts. In order to avoid any collision between cover and cross struts, the latter are advantageously bent away from the cover.

In order to avoid corners and edges, the upper sides of the hollow sections in the sitting and lying position of the respective piece of furniture have in each case an arc-shaped contour in a direction transverse to their longitudinal extension.

If the seat and/or backrest parts, configured according to the invention, are part of a folding chair or folding lounger, the hollow sections holding the cover preferably form in each case part of the side frame halves of the corresponding piece of furniture. They then extend parallel to the flat surfaces gripped by these frame halves.

The described construction allows the furniture to be dismantled into the two frame halves on the one hand, and the sitting and lying surfaces, namely the cover, on the other hand. In this way the pieces of furniture can be reduced to a minimal transporting space. In one portion of the packaging there is space for the frame halves and the connecting struts. In a further portion of the packaging the small parts and cover are accommodated. These two partial packages are combined in a carton-like total package which is preferably made to be stackable. The total package can also have a carrying handle.

Due to the construction according to the invention, there exists for the customer the possibility of combining a specific piece of furniture with a desired cover. In addition, there is the possibility of subsequently exchanging the cover. The frame portions can be produced either in plastic or in aluminium. By preference they are offered in white, a natural anodized color or a dark anodized color. The customer can then choose, according to his own taste, a cover which matches the frame in design and coloration.

Finally, the customer also has the possibility of adjusting the tension of the cover after lengthy use.

Figure 2:
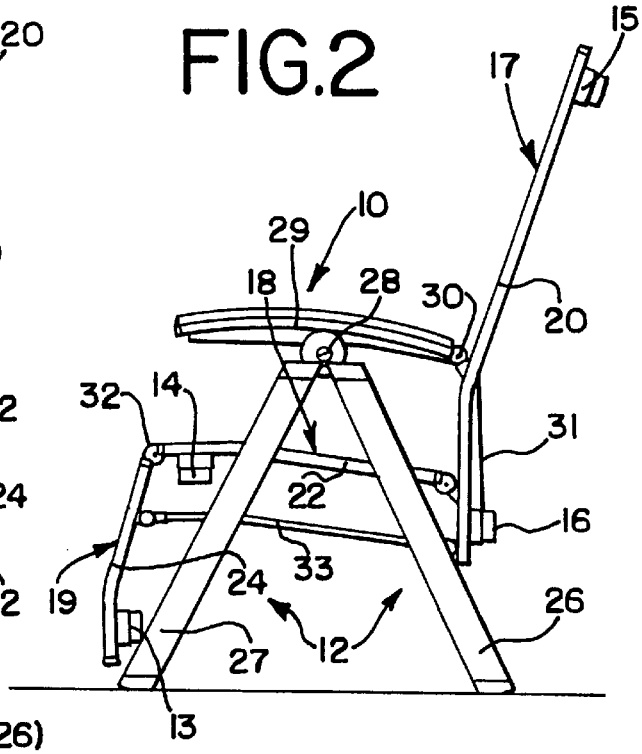
Figure 3:
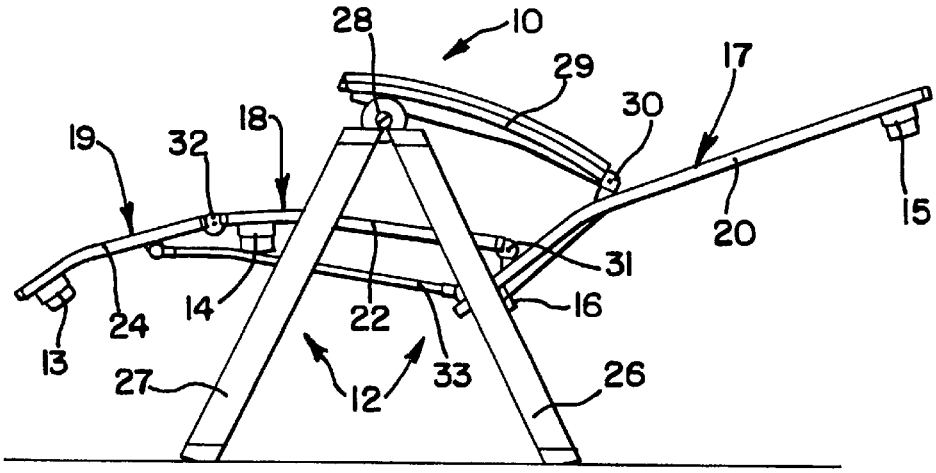
Figure 4:
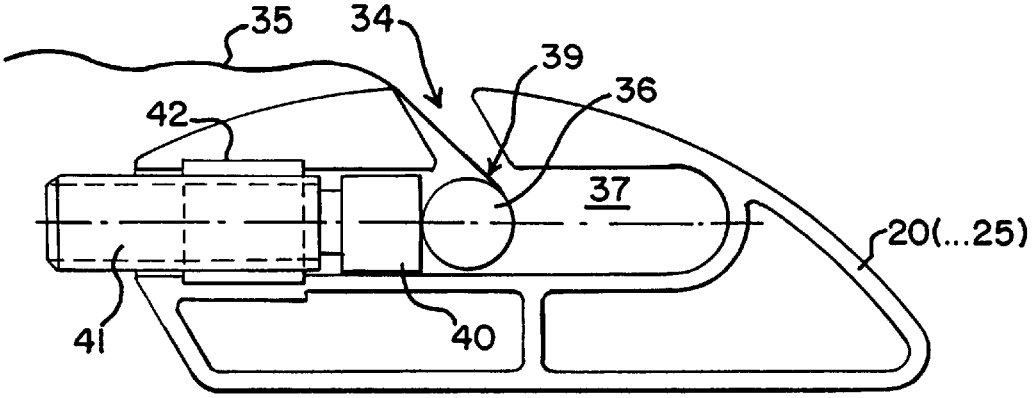
Figure 5:
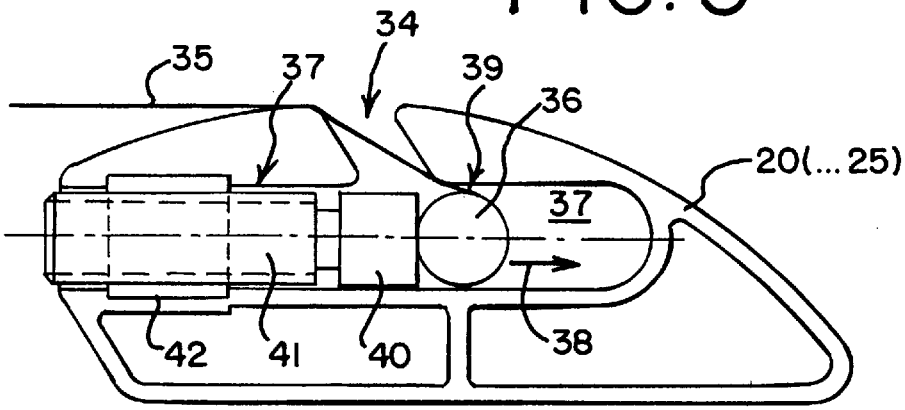
Figure 6:
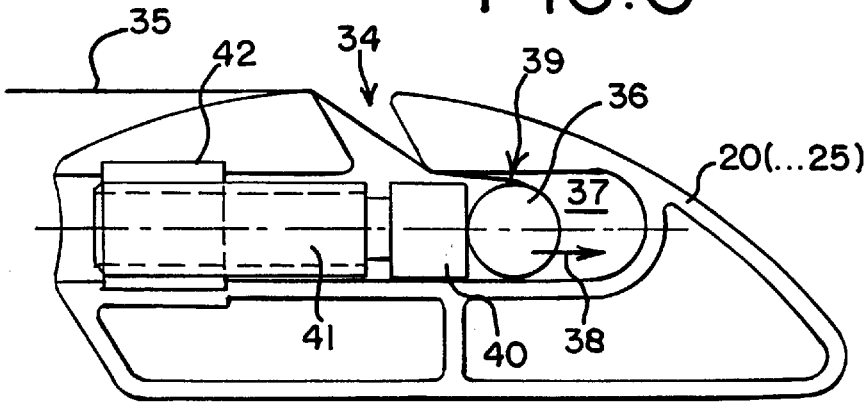

The hollow section/cover concept according to the invention plus a piece of furniture fitted with same, namely a folding chair, are described in greater detail below with the aid of the enclosed drawing. The diagrams show:

FIG. 1 a folding chair in front elevation;

FIG. 2 the folding chair according to FIG. 1, in side view;

FIG. 3 the folding chair according to FIG. 2, likewise in side view but in a lying position;

FIG. 4 to FIG. 6 a hollow section configured according to the invention with a tensioning device for the cover, showing the insertion position, tensioning position, and tension regulating position, in each case in diagrammatic cross-section.

In FIGS. 1 to 3 a folding chair 10 is shown which includes two frame halves 11, 12 which are connected to one another by cross struts 13, 14, 15 and 16. In addition, the folding chair 10 comprises a backrest 17, sitting surface 18 and leg support 19. The backrest, sitting surface and leg support in each case include a textile cover which is attached or anchored to hollow sections 20, 21, 23, 24, 25 themselves extending parallel to the flat surfaces gripped by the two frame halves 11, 12. The construction of the anchorage is gone into in greater detail below with reference to FIGS. 4 to 6.

The two frame halves 11, 12 are formed by two chair legs 26, 27 hinged to one another. The hinge joint is indicated by the reference number 28. On each of these hinges 28 there is supported an armrest 29 so as to be movable longitudinally. On the rear side, the armrests 29 are hinged to the two side hollow sections 20, 21 of the backrest 17 (hinge joint 30). The backrest 17 is connected to sitting surface 18 via a hinge joint 31, and the sitting surface 18 is connected via a hinge joint 32 with the leg support 19. The backrest 17 extends downwards over the hinge joint 31 with the sitting surface 18. The lower free end Ls connected to the leg support 19 via two struts 33 which are each hinged to the two side hollow sections 20, 24 or 21, 25 of the backrest and leg support. What is achieved by these connecting struts 33 is that, when the back rest is folded back into a lying position according to FIG. 3, the leg support 19 is inevitably swung forward up into a lying position. The leg support 19 then represents a kind of continuation of the sitting surface 18. Reference is made in this connection to the position in FIG. 3.

The folding chair construction according to FIGS. 1 and 3 is itself known. The above description therefore is essentially only in the interest of better understanding for the following description of the construction according to FIGS. 4 to 6.

In FIGS. 4 to 6, one of the hollow sections 20 to 25 mentioned is shown in diagrammatic cross-section. On the underside of these hollow sections 20 to 25 are mounted the abovementioned cross struts 13 to 16. Cross struts 13 to 16 guarantee the necessary spacing between the two longitudinal frame halves 11 and 12 of the folding chair 10 or of a corresponding piece of furniture, such as, for example, a folding lounger or the like.

The upper side of each hollow profile in its assembled state has an arc-shaped contour, especially in the shape of an arc of a circle. The underside is configured flat. Due to the arc-shaped contour in a direction perpendicular to the longitudinal extension of the hollow section, a gentle transition from the sitting surface to the outer edge of same is produced. The same is true of the backrest and the leg support. In addition, there is located on the upper side of each hollow section a longitudinal slot 34 directed towards the cover or diagonally inwards, through which slot the edge region of a cover 35 extends in the assembled state. The edge of the cover 35 associated with the hollow section is provided with an edge bead or with an edge strip. On the type of embodiment shown, the edge strip is formed by a round rod 36 driven into the edge of the cover 35. The edge strip formed in this way is held inside a longitudinal hollow space 37 of the hollow section 20 . . . 25, this longitudinal hollow space being configured like a longitudinal groove and having a height only slightly larger than the diameter of the edge strip, in such a way that an edge strip placed in it may be displaced in a direction transverse to its longitudinal extension, as can be clearly seen from FIGS. 4 to 6. The diameter of the round rod 36 is somewhat larger than the width of the longitudinal slot 34. This ensures that the cover 35 is held on to the associated hollow section 20 . . . 25.

Each hollow section 20 . . . 25 is open on a face accessible from the outside. The cover 35 together with the edge strip can be led into the hollow section 20 . . 25 through this open face and the longitudinal slot 34. By preference, after the cover has been inserted, the open face of the hollow section is closed by means of a cap made of plastic or the like, in order to ensure that, after assembly, the cover does not again slip out of the hollow section of its own accord.

FIG. 4 shows the condition as a cover is inserted or pulled into the associated hollow sections. The cover 35 itself is slack at this stage.

The cover 35 is then tensioned by means of a tensioning device 43 associated with the edge strips in accordance with FIG. 5, this being done in a direction transverse to the longitudinal extension of the round rod 36 or associated hollow section 20 . . . 25. To this end, the associated edge strip is displaced outwards (part 38) inside the hollow space 37 (=edge strip groove), which is like a longitudinal groove, in a direction transverse to its longitudinal extension. The cover 35 is tensioned by this displacement of the edge strip or round rod 36.

FIG. 6 shows an adjustment of the tension of the cover 35, which is possible if required. To this end, the edge strip or the round rod 36 associated with the edge strip is moved even further outwards in the direction of arrow 38.

In FIGS. 4 to 6 the edge strip above is provided with the reference number 39.

The tensioning device 43 associated with one edge strip 39 comprises a push rod 40, which is arranged inside the hollow section 20 . . . 25, namely inside the longitudinal groove-like hollow space 37 and which lies adjacent to each edge strip 39 on the side of the edge strip facing the cover, as well as at least one tension screw 41 which impinges on the push rod 40 on the side facing the cover 35, and is supported inside a threaded bush anchored in the hollow section 20. In the embodiment shown here, the threaded bush 42 is in practice anchored to the open side of the hollow space 37 which is like a longitudinal groove.

The tension screw 41 is supported on the push rod 40 via a sliding center bearing. On the opposite side which is accessible from the outside, the tension screw 41 has a hexagon socket, not shown here, into which a corresponding turning tool may be inserted.

The hollow sections 20 . . . 25, which serve as side longitudinal bars of the backrest 17, sitting surface 18 and leg support 19, consist preferably of aluminium. Alternatively, they can also be made of plastic. This is not least a question of outlay and the necessary stability as well as of weathering resistance.

It goes without saying that it is in each case sufficient for the backrest, sitting surface and leg support just to provide an edge strip tensioning device on one of the two hollow sections. Furthermore, it is self-evident that those hollow sections which have no tensioning device also do not have to have a longitudinal groove-like hollow space. A longitudinal hollow space with a keyhole-like cross-section is sufficient there.

The edge strip tensioning construction described above is not intended to be restricted to seat and/or backrest parts of folding furniture; the described and claimed construction and technology is also claimed for tent constructions in general, i.e. for constructions which are characterized by having a cover between frame parts which are at a distance from one another. This includes, for example, the seat cover between the two longitudinal frame parts of a sledge.

All the features disclosed in the application documents are claimed as essential for the invention as far as they are new in relation to the state of the art, either individually or in combination.

We claim:

1. A seat and/or backrest part of folding furniture, comprising: a frame and a cover configured for being anchored to said frame; said frame having hollow sections arranged at a distance from one another for determining a dimension of a surface of at least one of the seat and backrest, said hollow sections being open on at least one face, each hollow section having a longitudinal slot with a width and being configured in such a way that said cover may be inserted into said open face of said hollow sections and through said longitudinal slots, edges of said cover being held inside said hollow sections by edge strips formed on said cover, said edge strips each having a diameter being greater than the width of said longitudinal slots in said hollow sections, a continuous hollow elongate space being located in at least one of said sections, wherein said edge strips are displaceable within said continuous hollow elongate space, said hollow elongate space being configured so that said edge strips can only be displaced in substantially one direction and further including tensioning means disposed within said hollow elongate space for adjustably displacing said edge strips in said direction.

2. The seat and/or backrest part according to claim 1 wherein said edge strips of said cover are formed by a rod driven into a corresponding one of the edges of said cover.

3. The seat and/or backrest part according to claim 1 wherein said tensioning means associated with said edge strips of said cover includes a push rod disposed inside said hollow section, and which lies adjacent to each said edge strip on a side facing said cover, as well as at least one tension screw which impinges on said push rod at said side facing said cover and is supported inside a threaded bore hole formed in said hollow section.

4. The seat and/or backrest part according to claim 1 wherein said hollow section is manufactured from the group of materials consisting of plastic and metal.

5. The seat and/or backrest part according to claim 1 wherein said hollow sections of at least one of said seat and said backrest part are connected to one another by cross struts to form a stable or self-supporting frame.

6. The seat and/or backrest part according to claim 1 wherein an upper side of each said hollow section in a sitting and lying position of a respective piece of furniture has a contour in the shape of an arc of a circle in a direction transverse to said longitudinal slot.

* * * * *